United States Patent [19]

Laubach et al.

[11] 4,200,400

[45] Apr. 29, 1980

[54] MIXING CAR FOR TRANSPORTING MOLTEN METALS

[75] Inventors: Winfried Laubach; Heinz Kienbaum, both of Oberhausen; Rolf Thomas, Bottrop, all of Fed. Rep. of Germany

[73] Assignee: Gutehoffnungshütte Sterkrade A.G., Fed. Rep. of Germany

[21] Appl. No.: 971,942

[22] Filed: Dec. 22, 1978

[30] Foreign Application Priority Data

Dec. 27, 1977 [DE] Fed. Rep. of Germany ..... 2758293

[51] Int. Cl.[2] ..... B01F 9/02

[52] U.S. Cl. ..... 366/233; 366/63

[58] Field of Search ..... 366/62, 63, 220, 233, 366/213, 218, 54

[56] References Cited

U.S. PATENT DOCUMENTS

| | | | |
|---|---|---|---|
| 3,033,057 | 5/1962 | Gray | 366/220 |
| 3,036,823 | 5/1962 | Taylor | 366/233 |
| 3,386,718 | 6/1968 | Abbott | 366/233 |
| 3,897,936 | 8/1975 | Berthold | 366/233 |
| 3,942,453 | 3/1976 | Stabel | 366/233 |

*Primary Examiner*—Robert W. Jenkins
*Attorney, Agent, or Firm*—McGlew and Tuttle

[57] ABSTRACT

A mixing car for transporting molten metals, comprises, a car undercarriage with a longitudinally elongated mixing vessel supported on the undercarriage at each end for rotation about a horizontally disposed longitudinal axis of the vessel. The support means at at least one end comprises a support bridge frame which is universally pivotally mounted on the undercarriage and is provided with journals on each side for accommodating a support roller shaft which is held in position in respect to the support bridge frame by an anti-rotation safety. The roller shafts include ends which extend outwardly from each longitudinal end of the bridge frame and hollow rollers are mounted on each projecting end of the roller shaft on suitable roller bearings. Interior support rollers are also provided which are affixed to the end of the shaft outboard of the roller bearings and which carry diametrically opposite rollers which engage and support the support rollers. The support rollers, in turn, bear against races of annular roller bearing races which are disposed around the vessel longitudinally on each side of a central annular drive gear.

4 Claims, 5 Drawing Figures

1
2
2a
7
7a
6
6a
4
5a
5
3
X2
60
III

X1
3c
3d
3a
3b
3e

MIXING CAR FOR TRANSPORTING MOLTEN METALS

FIELD AND BACKGROUND OF THE INVENTION

This invention relates to the construction of mixing cars for transporting molten metals in general and, in particular, to a new and useful mixing car having means for supporting a mixing vessel on an undercarriage so as to ensure a contact over the entire roller width of the roller supports therefor.

DESCRIPTION OF THE PRIOR ART

The invention relates to a mixing car for transporting molten metals, with an oblong, essentially cylindrical vessel, its central part and end parts either tapering off, being reduced in steps, or being of the same diameter blending into each other, and the rotary motion being accomplished through rollers and races located at the ends of the vessel and mounted in a frame supporting the tilting drive, according to Patent Application No. P 25 55 198.8–24.

It is an object of the invention to provide a mixing car of the type mentioned in the main patent (Patent Application No. P 25 55 198.8–24) which assures line contact between races and rollers over the entire race and roller width.

According to the main invention, this problem is solved in that the rollers (3) in contact with the races (1) of the mixing vessel (2) are mounted so as to allow pendulum motion to all sides in the frame (4) which is supported, via a ball cup (5) for rotation, by the bridge of the undercarriage (6), the power-transmitting drive assembly (7) of the tilting drive being disposed so that the pinion (7*a*) engages annular gear (2*a*) of the vessel (2) in the center between the longitudinally spaced races (1).

The first feature of this solution, namely that the rollers (3) in contact with the races (1) of the mixing vessel (2) be disposed so as to allow pendulum motion to all sides in the frame (4), is to be further developed advantageously by this supplemental invention.

It starts from the premise that, due to unavoidable frame deformations caused by the great weights of the charges, contact over the entire roller width is not assured with certainty when the rollers are mounted normally and that the uncontrollably higher specific loading caused thereby leads to the destruction of the rollers and/or races.

However, line contact between rollers and races is assured by designing the rollers in accordance with the first feature of the main invention (Patent Application No. P 25, 55 198.8–24).

It is an object of the supplemental invention to design the rollers allowing pendulum motion to all sides so as to prevent a transition from line contact between race and roller to point contact.

According to the supplemental invention, this problem is solved in that the shaft (3*a*) of the rollers (3) is mounted in the frame (4) and is secured against twisting by an antirotation safety (3*e*) and that all-sided pendulum motion of the rollers (3) in contact with the races (1) of the mixing vessel (2) and disposed in the frame (4) is, for the maintenance of contact over the entire roller width by means of assembly elements (3*b,c,d*) disposed inside the rollers (3) limited in such a manner that (a) unlimited pendulum motions of the rollers (3) about the axis $X_1$—$X_1$ (b) only extremely restricted pendulum motions of the rollers (3) about the axis $X_2$—$X_2$ are possible due to the arrangement of support rollers (3*b*) and their retaining means (3*d*).

Accordingly, an object of the present invention is to provide a mixing car for transporting molten metals, which comprises, a car undercarriage with a longitudinally elongated mixing vessel supported on the undercarriage for rotation about a substantially horizontal, longitudinally extending axis, wherein, the support includes a support bridge frame which is universally pivotally mounted on the undercarriage and which provides journals on each side thereof for shafts of support rollers which are fixed to the frame against rotation and which support the support rollers on bearings so that they contact and support the vessel by engagement with annular ball bearing races which are carried around the periphery of the vessel on each side of an annular drive gear which is driven through a separate drive motor carried on the undercarriage and, wherein, the hollow vessel support rollers are also supported by interior support rollers arranged at diametrically opposite locations and which bear against the support rollers so as to permit unlimited pendulum motion of the rollers about an axis extending through the center of the interior support rollers and only extremely restricted pendulum motion of the support rollers about an axis which extends from the center of the rotatable vessel through the center of rotation of the support rollers.

A further object of the present invention is to provide a mixing car for transporting molten metals which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
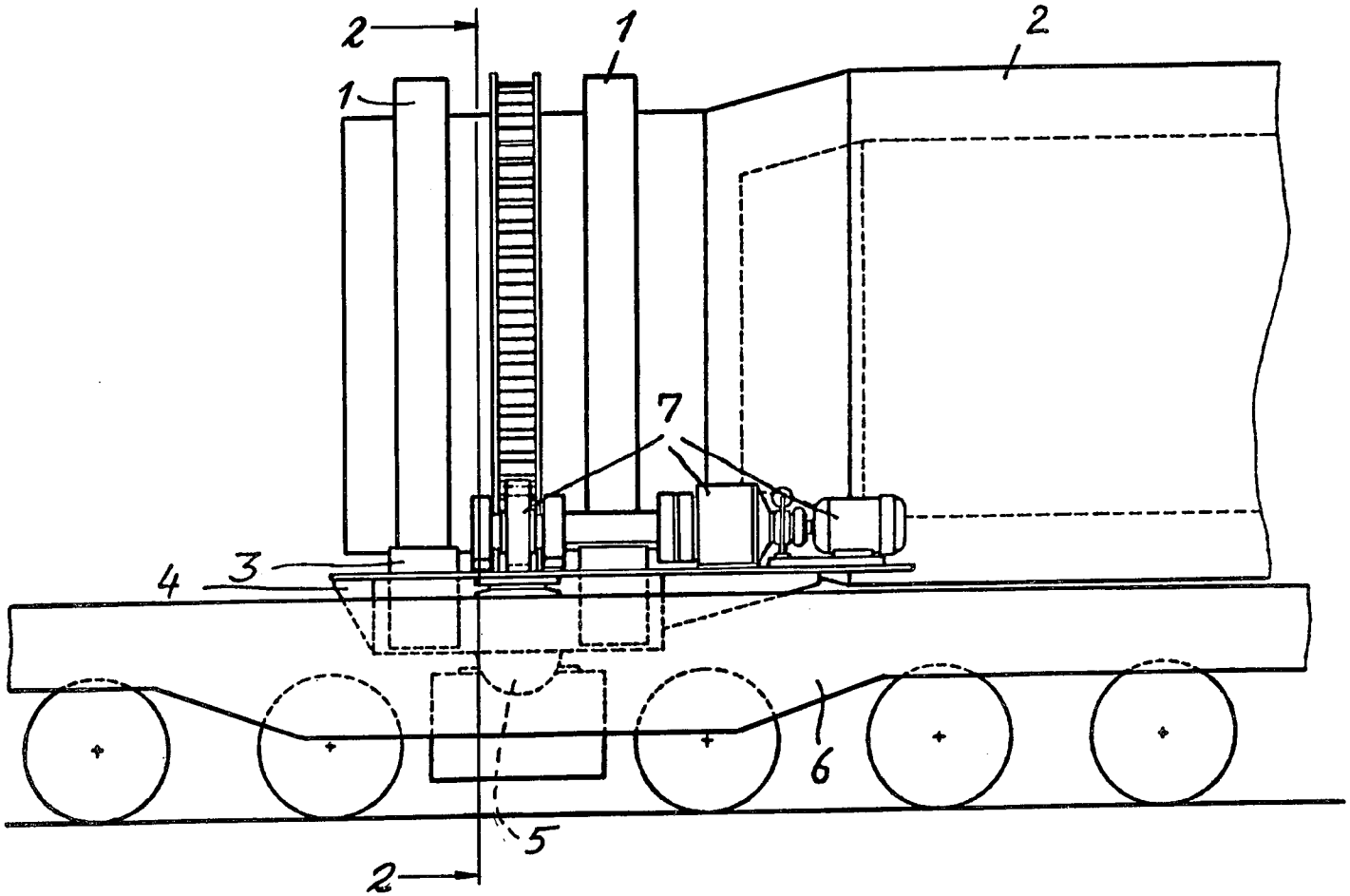
FIG. 1 is a partial side elevational view of a mixing car constructed in accordance with the invention.

Referring to the drawings in particular, the invention embodied therein, comprises, a mixing car for transporting molten metals which comprises an undercarriage 6 having wheels 6*a* which move over a track 60. A support bridge frame 4 is universally, pivotally mounted on the undercarriage by means of a ball portion 5*a* carried by the frame 4 which engages in a ball cup 5 of the undercarriage.

Figure 5:
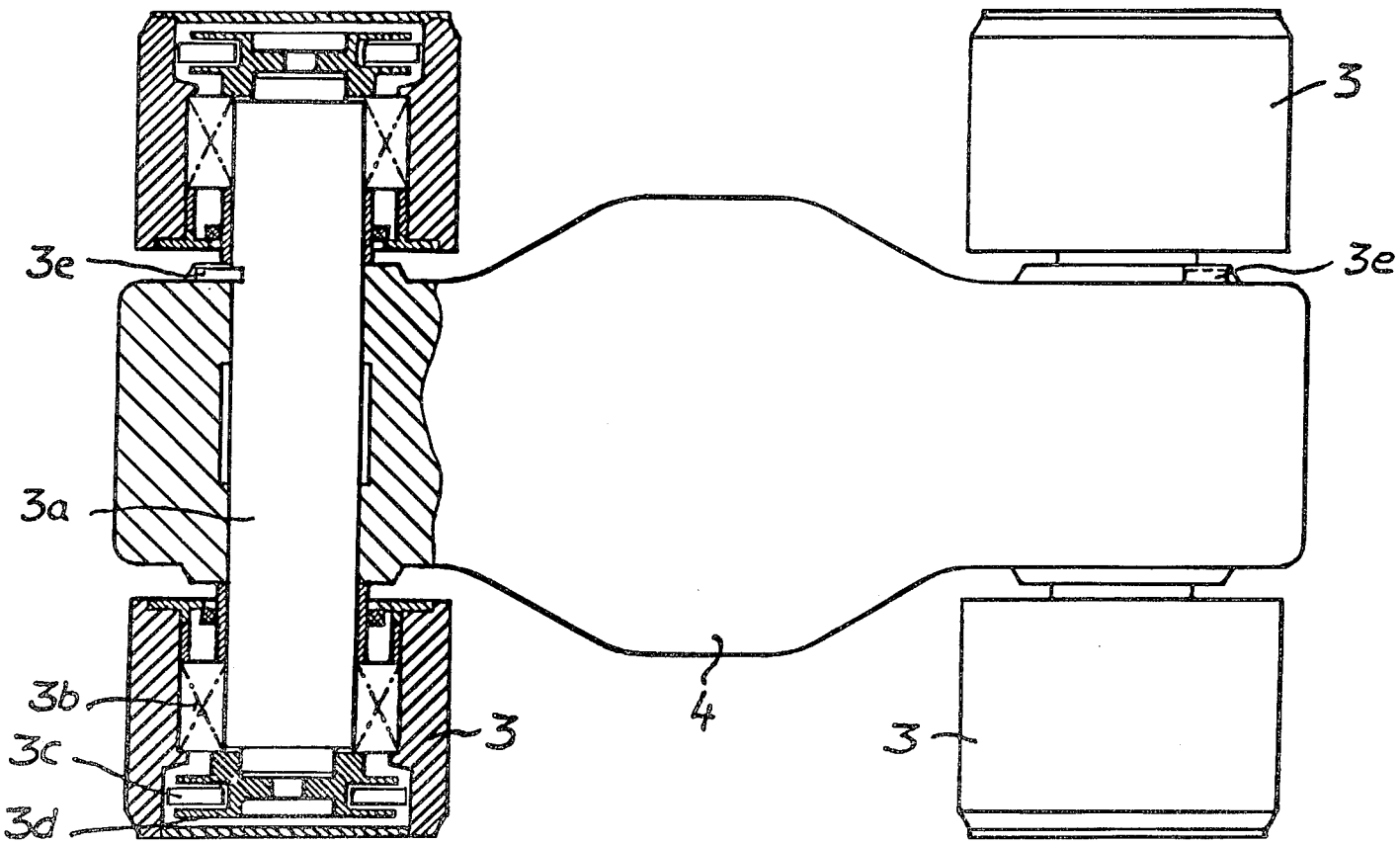
FIG. 5 is a view similar to FIG. 4 showing the whole mounting of the mixing car frame.

As best seen in FIG. 5, the support bridge frame 4 includes central journal portions at each side which receive support roller shafts 3*a*. Each support roller shaft 3*a* has an outwardly extending portion which extends longitudinally beyond the frame 4 and a hollow support roller 3 is fitted over this end and supported thereon for rotation by means of roller bearings 3*b*.

In accordance with a feature of the invention, the support rollers 3 are also supported by means of interior support roller means including a holder or retainer means 3*d* which is affixed to an extension of the shaft 3*a* and interior support rollers 3*c*, 3*c* which are located in diametrically opposite locations and bear against the interior of the support roller 3. Support rollers 3*c* are carried by the retainer means 3*d* in a position in which they insure unlimited pendulum motions of the rollers 3 about an axis $X_1$—$X_1$which extends through the center of the roller 3 and through the centers of the interior rollers 3*c*. In addition, the construction permits only extremely restricted pendulum motion of the rollers 3 about an axis $X_2$—$X_2$ which extends from the center of the vessel 2 through the center of the supporting rollers 3.

The parts which have been enumerated above are designated as follows:

1—the races at the end of the mixing vessel 2;
2—the mixing vessel;
2*a*—the drive gear;
3—the rollers in contact with the races 1;
3*a*—the shaft of the roller 3;
3*b*—the self-aligning roller bearings in contact with 3*a;*
3*c*—the supporting rollers inside the rollers 3;
3*d*—the holder or retaining means for the supporting roller 3*c;*
3*e*—the antirotation safety for 3*a;*
4—the frame;
5—the ball cup for rotation;
5*a*—the ball portion;
6—the undercarriage;
6*a*—the wheels for undercarriage;
7—the power-transmitting drive assembly;
7*a*—the drive pinion; and
60—the track.

As is evident from FIG. 5, the antirotation safety 3*e* prevents the shaft 3*a* of the roller 3 from turning in the frame 4.

Figures 2, 3, 4:
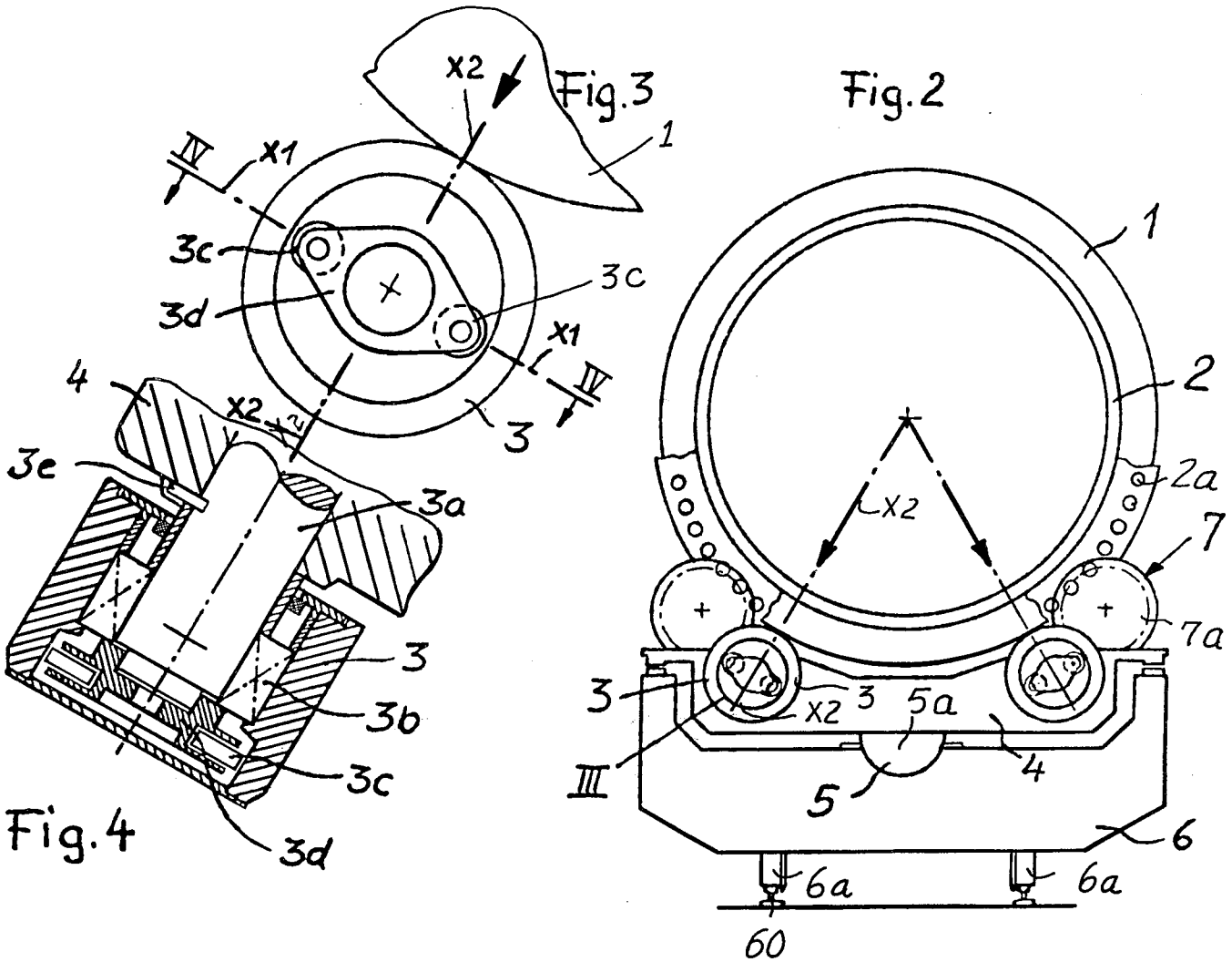
FIG. 2 is a section taken along the line 2—2 of FIG. 1.
FIG. 3 is a detailed sectional view in the direction of arrow III of FIG. 2.
FIG. 4 is a transverse section of the part shown in FIG. 3.

The assembly elements 3*b, c, d* mounted inside the roller 3 and shown in FIG. 4 assure that the rollers 3 in FIG. 3 can perform unlimited pendulum motions about an axis $X_1$—$X_1$, but only very limited pendulum motions about the axis $X_2$—$X_2$.

The limitation of the pendulum motion of the rollers 3 about the axis $X_2$—$X_2$ by means of the support rollers 3*c* and their retaining means 3*d* as shown in FIG. 4 prevents the transition from line contact between the races 1 and the rollers 3 to point contact.

On the other hand, the permitted pendulum motions of the rollers 3 are sufficient to prevent with certainty the destruction of the races 1 and rollers 3.

While a specific embodiment of the invention has been shown and described in detail to illustrate the application of the principles of the invention, it will be understood that the invention may be embodied otherwise without departing from such principles.

What is claimed is:

1. A mixing car for transporting molten metals, comprising, a car undercarriage, a longitudinally elongated mixing vessel rotatably supported on said undercarriage, support means on said undercarriage for rotatably supporting said vessel for rotation about its longitudinal axis, first and second longitudinally spaced ball bearing races carried on the periphery of said vessel adjacent an end thereof, an annular drive gear disposed between said first and second annular ball bearing races and around said vessel, drive means including a drive pinion engaged with said annular gear for rotating said vessel, said support means including at least one support bridge frame, mounting means mounting said support bridge frame for universal pivotal movement on said undercarriage, a longitudinally extending roller shaft journalled in said support bridge frame adjacent each side thereof, antirotation safety means engaged with said support bridge frame and said roller shaft to hold said roller shaft against rotation in respect to said support bridge frame, said roller shaft having an end part at each end extending outwardly beyond said support bridge frame, a hollow vessel support roller engaged over said shaft, roller bearing means between said hollow support roller and said shaft for rotatably supporting said hollow support roller on said shaft so that the exterior of said support roller engages against a respective first and second race, an interior roller retainer affixed to said shaft exteriorly of said roller bearings, an interior roller carried by said retainer at diametrically opposite locations engaged with the interior of said support roller and permitting unlimited pendulum motion of said support roller about an axis extending through the center of rotation of said support roller and the axis of rotation of said interior support rollers and only extremely restricted pendulum motions of the support roller about an axis extending through the axis of said mixing rollers and the axis of said support vessel.

2. A mixing car for transporting molten metals, as claimed in claim 1, wherein said shaft portion which extends outwardly on each side of said support bridge frame includes an outer end portion of a smaller diameter than the remainder of said shaft, said retainer having a hub portion engaged on said smaller diameter portion and having arm portions extending outwardly in respective diametric opposite sides carrying respective interior support rollers.

3. A mixing car for transporting molten metals, as claimed in claim 1, wherein said drive motor is arranged on one side of said vessel and has a drive shaft with a gear thereon engaged with said annular gear.

4. A mixing car for transporting molten metals, as claimed in claim 1, wherein said antirotation safety means comprises a member carried by said support bridge frame and engaged into said shaft.

* * * * *